US005092480A

United States Patent [19]

Waterston

[11] Patent Number: 5,092,480

[45] Date of Patent: Mar. 3, 1992

[54] WASTEBASKET COMPONENT SYSTEM FOR RECYCLABLE WASTE MATERIALS

[75] Inventor: Rebecca L. Waterston, Plymouth, Minn.

[73] Assignee: Liberty Diversified Industries, New Hope, Minn.

[21] Appl. No.: 644,557

[22] Filed: Jan. 23, 1991

[51] Int. Cl.[5] ..... B65D 1/36

[52] U.S. Cl. ..... 220/23.4; 220/23.83; 220/909

[58] Field of Search ..... 220/23.4, 23.83, 23.86, 220/908, 909

[56] References Cited

U.S. PATENT DOCUMENTS

| | | | |
|---|---|---|---|
| 1,613,671 | 1/1927 | O'Donnell | 220/23.83 X |
| 3,606,893 | 9/1971 | Verberg | 220/23.4 X |
| 3,742,965 | 7/1973 | Hudziak | 220/23.86 X |
| 3,856,173 | 12/1974 | Deane et al. | 220/23.83 X |
| 4,801,034 | 1/1989 | Sandomeno | 220/23.83 |
| 4,834,253 | 5/1989 | Crine | 220/23.4 |
| 4,878,592 | 11/1989 | Lee | 220/23.83 |
| 4,940,159 | 7/1990 | Callas | 220/909 X |

*Primary Examiner*—Steven M. Pollard
*Attorney, Agent, or Firm*—Moore & Hansen

[57] ABSTRACT

A modular waste disposal receptacle system particularly suited for recyclable waste materials comprising a primary wastebasket and a plurality of smaller secondary receptacles, the primary wastebasket and secondary receptacles having substantially similar or identical overall shapes and constructions but different and interrelated overall sizes or dimensions. One or more of the secondary receptacles may be nested within the primary wastebasket with the longer or major axis of the secondary receptacle being oriented perpendicular to the major axis of the primary wastebasket and the top rim of the secondary receptacle extending outwardly above and contacting the top rim of the primary wastebasket to elevate and support the secondary receptacle above the bottom wall of the primary wastebasket. Alternately, one or more of the secondary receptacles may be placed in hanging attachment on the top rim of the primary wastebasket using a hanger member that may be removably and pivotally attached to the respective secondary receptacle.

12 Claims, 1 Drawing Sheet

WASTEBASKET COMPONENT SYSTEM FOR RECYCLABLE WASTE MATERIALS

BACKGROUND OF THE INVENTION

This invention relates generally to wastebaskets and refuse receptacles of the type utilized in household and office settings, and particularly to a modular wastebasket component system for the sorting and disposal of recyclable waste materials.

Various receptacles including boxes and cartons are known for use in the sorting and disposal of recyclable waste materials in household and office settings, particularly for separating different types of recyclable and non-recyclable papers. These boxes and cartons are generally fabricated from a folded blank of corrugated cardboard or corrugated plastic sheet material, and may be placed closely proximate to conventional wastebaskets or hung on the rim of conventional wastebaskets using a hanger member.

However, these boxes and cartons require assembly or folding to an upright and usable configuration, and may in some instances detract from the visual aesthetics of a particular office or household setting. These boxes and cartons generally have a more limited volume that may prove restrictive in some applications, and increasing the volume of the receptacle areas may cause a disproportionate increase in the size of the blank and the cost of the sheet material consumed Moreover, the construction of these boxes and cartons can sometimes present open edges, crevices, and pockets that trap small scraps of waste material when the boxes or cartons are inverted for emptying. The boxes and cartons may also present open seams or cracks that make the boxes or cartons unsuitable for use with recyclable waste materials other than dr paper that may contain fluids, foodstuffs, medical wastes, or other refuse that would require the receptacles to be completely emptied and to be cleaned or sterilized prior to reuse.

BRIEF SUMMARY OF THE INVENTION

It is therefore one object of this invention to design a modular waste disposal receptacle system comprising a primary wastebasket and one or more secondary receptacles in which the primary wastebasket and the secondary receptacles have a similar appearance and construction It is an additional object of this invention to design the above modular waste disposal receptacle system such that the primary wastebasket and the secondary receptacles may be selectively and alternately utilized by placing the secondary receptacles in a freestanding position in close proximity to the primary wastebasket, in hanging engagement on the primary wastebasket, or in a stacked and nested configuration within the primary wastebasket.

It is a further object of this invention to design the above modular waste disposal receptacle system such that the secondary receptacles may be nested within the primary wastebasket for storage and shipment.

It is a yet another object of this invention to design the above modular waste disposal receptacle system such that the construction of the secondary receptacles is substantially identical to but reduced in size compared to the primary wastebasket.

It is a related object of this invention to design the above modular waste disposal receptacle system such that primary wastebasket and the secondary receptacles are fabricated from a plastic material allowing the primary wastebasket and the secondary receptacles to be cleaned and sterilized, which are fluid-tight, and do not present crevices or pockets which would retain waste materials when the primary wastebasket or secondary receptacles are inverted.

Briefly described, the modular waste disposal receptacle system comprises a primary wastebasket and a plurality of smaller secondary receptacles, the primary wastebasket and secondary receptacles having substantially similar or identical overall shapes and constructions but different and interrelated overall sizes or dimensions. One or more of the secondary receptacles may be nested within the primary wastebasket with the longer or major axis of the secondary receptacle being oriented perpendicular to the major axis of the primary wastebasket and the top rim of the secondary receptacle extending outwardly above and contacting the top rim of the primary wastebasket to elevate and support the secondary receptacle above the bottom wall of the primary wastebasket. Alternately, one or more of the secondary receptacles may be placed in hanging attachment on the top rim of the primary wastebasket using a hanger member that may be removably and pivotally attached to the respective secondary receptacle.

DESCRIPTION OF THE PREFERRED EMBODIMENTS

Figure 1:
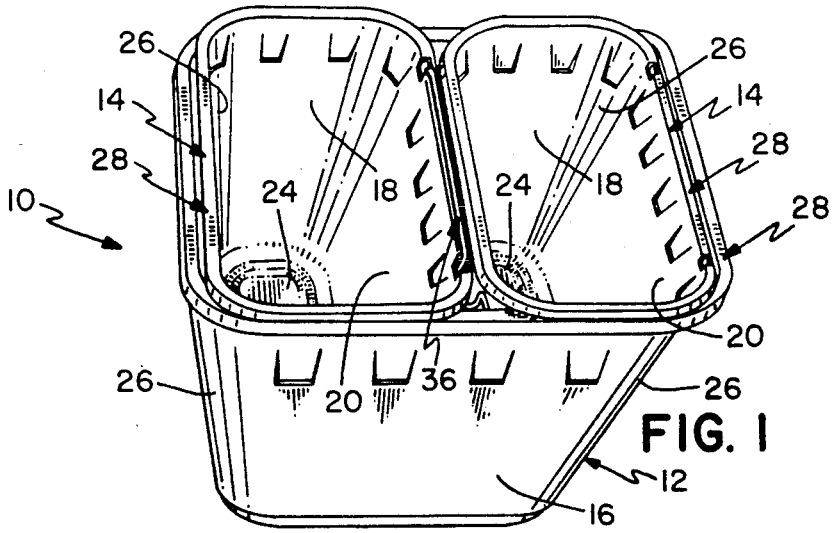
FIG. 1 is a front perspective view of one embodiment of the modular waste disposal receptacle system of this invention showing two secondary receptacles disposed in a side-by-side elevated nested position within the primary wastebasket.
Figure 2:
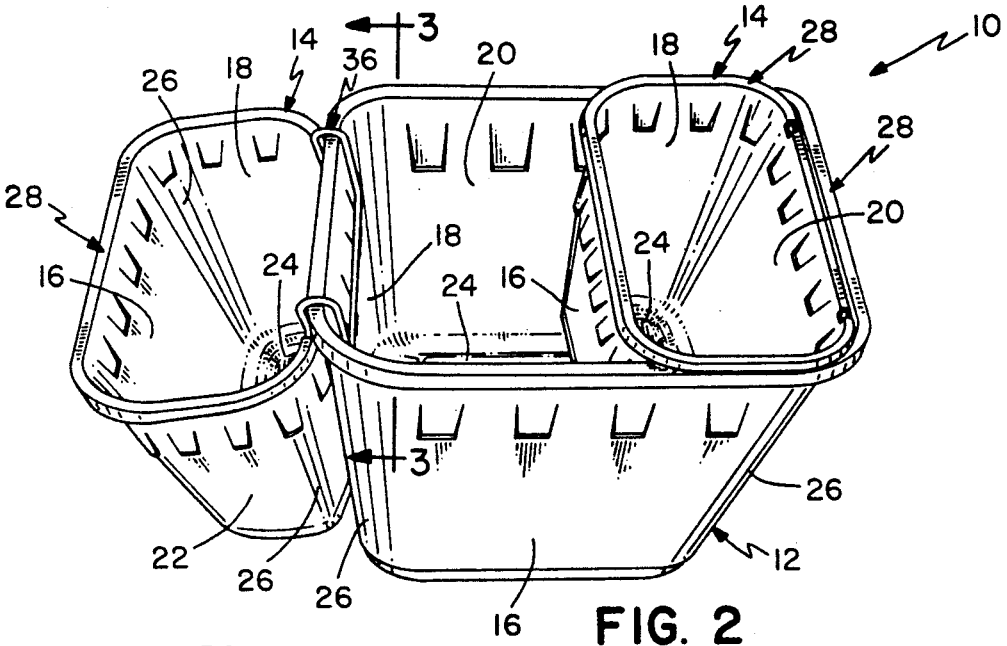
FIG. 2 is a front perspective view of an alternate embodiment of the modular waste disposal receptacle system of this invention showing one secondary receptacle disposed in an elevated nested position within the primary wastebasket and one secondary receptacle disposed in hanging attachment on the rim of the primary wastebasket.
Figure 3:
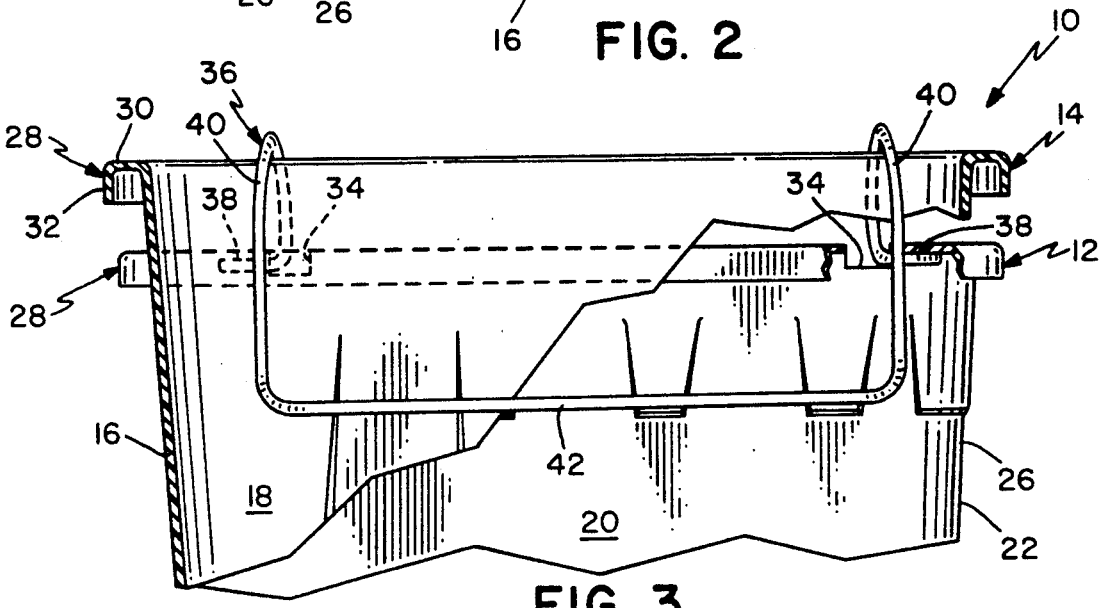
FIG. 3 is a partial cross-section view of the primary wastebasket and secondary receptacle in hanging attachment on the primary wastebasket taken through line 3—3 in FIG. 2.

The modular waste disposal receptacle system of this invention is shown in FIGS. 1–3 and referenced generally therein by the numeral 10.

Referring particularly to FIGS. 1 and 2, it may be seen that the modular waste disposal receptacle system 10 is comprised of at least one primary receptacle or wastebasket 12 and at least one but preferably a plurality of smaller secondary receptacles 14.

Each of the primary wastebasket 12 and secondary receptacles 14 has a substantially similar or identical overall shape and construction, with the exceptions described in further detail below concerning the overall sizes and dimensions of the primary wastebasket 12 and secondary receptacles 14 and other features of the secondary receptacles 14 relating to their mounting on the primary receptacle 12. The common points of this substantially similar or identical construction include a one-piece unitary or integral body formed or injection molded from a plastic resin such as polyethylene, the body having four generally upright tapered side walls 16, 18, 20, 22 and a bottom wall 24 having a generally rectangular peripheral edge from which each of the side walls 16, 18, 20, 22 extend upwardly.

Each of the side walls 16–22 are connected to and extend from one another along curved or radiused corners 26 of the respective primary wastebasket 12 or secondary receptacle 14, and each of the side walls 16–22 are similarly connected to and extend from the peripheral edge of the bottom wall 24 along curved, radiused, or beveled edges.

Referring particularly to FIG. 3, it may be seen that extending outwardly from the top edge of each side wall 16-22 of the respective primary wastebasket 12 or secondary receptacle 14 is a top rim 28, the top rim 28 comprising a horizontal portion 30 and a depending skirt portion 32. The depending skirt portion 32 is disposed a short distance from the respective side wall 16-22, that distance being sufficient to permit a user to lift the primary wastebasket 12 or secondary receptacle 14 by gripping the underside of the top rim 28 with their fingertips being at least partially received within the channel formed beneath the horizontal portion 30 and between the depending skirt portion 32 and side wall 16-22.

In the preferred embodiment, the primary wastebasket 12 has a height of approximately 15", with an open top having a longer or major axis with a length of approximately 13" and a shorter or minor axis with a width of approximately 9¼". Each of the side walls 16–22 taper inwardly and downwardly to the bottom wall 24, which has a longer or major axis with a length of approximately 12" and a shorter or minor axis with a width of approximately 7¾". The top rim 28 of the primary wastebasket 12 extends outwardly approximately 7/32" measured from the outer surface of the side wall 16–22 and the outer surface of the adjacent depending skirt portion 32.

The secondary receptacles 14 each have a height of approximately 9¾", with an open top having a longer or major axis with a length of approximately 9¼" and a shorter or minor axis with a width of approximately 5¼". Each of the side walls 16–22 similarly taper inwardly and downwardly to the bottom wall 24, which has a longer or major axis with a length of approximately 8¼" and a shorter or minor axis with a width of approximately 4¼". The corners 26 of the secondary receptacles 14 preferably have a radius of approximately 1¾", and the bottom wall 24 of the secondary receptacles 14 will therefore appear from below to be predominantly oval in shape rather than rectangular. The top rim 28 of the secondary receptacles 14 extends outwardly approximately 5/16" measured from the outer surface of the side wall 16–22 and the outer surface of the adjacent depending skirt portion 32.

Referring again to FIGS. 1–3, it may be seen that each of the secondary receptacles 14 define a pair of small square or rectangular apertures 34 spaced apart along the top rim 28 and side wall 16, 20 of one of the side walls 16, 20 corresponding to the longer or major axis of the respective secondary receptacle 14. Each aperture 34 has a length of approximately ⅜" and a width of approximately 3/16", the apertures 34 each extending downwardly into the associated side wall 16, 20 from the top surface of the horizontal portion 30 of the top rim 28 a distance of approximately 3/16". Each of the apertures 34 is spaced apart from one another a distance of 5½" as measured from the facing or inner confronting edges thereof.

The secondary receptacles 14 may optionally include a hanger member 36 having a pair of outwardly extending end segments 38, a pair of upwardly extending and rearwardly projecting looped segments 40 extending upwardly and connected to the inner side of each of the end segments 38, and a straight intermediate section 42 extending between and connected to the bottom and rear end of each of the looped segments 40. The hanger member 36 is preferably formed by bending a length of ⅛" diameter cylindrical metal wire such as aluminum or steel, with the looped segments 40 being spaced apart approximately 5¾" between the inner facing or confronting surfaces thereof.

The hanger member 36 may be attached to and pivotally mounted on the selected secondary receptacle 14 by inserting one of the end segments 38 through a corresponding and aligned one of the apertures 34, and flexing the side wall 16, 20 and top rim 28 of the secondary receptacles 14 and the straight section 42 of the hanger member 36 to permit the opposing end segment 38 to be received through the opposing aperture 34. The hanger member 36 may thus be pivoted between a hanging position whereat the lower ends of the looped segments 40 are generally parallel with the adjacent side wall 16, 20 and the straight segment 42 is disposed at a lowest point generally parallel with and spaced apart from the adjacent side wall 16, 20 a distance of approximately ⅞" and approximately 2" beneath the top surface of the top rim 28, and a lifted position wherein the hanger member 36 is pivoted upwardly and inwardly toward the center of the secondary receptacle 14 approximately 90° relative to the hanging position.

The primary wastebasket 12 and secondary receptacles 14 are thus sized such that a pair of secondary receptacles 14 may be nested side-by-side within the primary wastebasket 12 as shown in FIG. 1 for shipping or storage, with the major axes of the secondary receptacles 14 being perpendicular to the major axis of the primary wastebasket 12 and the top rim 28 of the secondary receptacles 14 extending outwardly above and contacting the top rim 28 of the primary wastebasket 12 to elevate and support the secondary receptacles 14 above the bottom wall 24 of the primary wastebasket 12, with one or both of the secondary receptacles 14 having hanger members 36 attached and confronting one another along the center of the primary wastebasket 12. Alternately, the secondary receptacles 14

The primary wastebasket 12 and secondary receptacles 14 may be utilized in a variety of configurations, including:

1) one secondary receptacle 14 nested within a primary wastebasket 12 and supported and elevated therein by the top rims 28 thereof with the major axis of the secondary receptacle 14 being perpendicular to the major axis of the primary wastebasket 12;
2) one secondary receptacle 14 in hanging attachment along one side wall 16–22 of a primary wastebasket 12 and supported and elevated thereon by the hanger member 36, the secondary receptacle 14 being disposed preferably along one of the shorter or end side walls 18, 22;
3) a first secondary receptacle 14 nested within a primary wastebasket 12 and supported and elevated therein by the top rims 28 thereof, and a second secondary receptacle 14 in hanging attachment along one side wall 16–22 of a primary wastebasket 12 and supported and elevated thereon by the hanger member 36, as shown particularly in FIG. 2;

4) two secondary receptacles 14 in hanging attachment along opposing side walls 16–22 of a primary wastebasket 12 and supported and elevated thereon by the hanger members 36, the secondary receptacles 14 being disposed preferably along the shorter or end side walls 18, 22; and 5) two secondary receptacles 14 in hanging attachment along opposing side walls 16–22 of a primary wastebasket 12 and supported and elevated thereon by the hanger members 36, the secondary receptacles 14 being disposed preferably along the shorter or end side walls 18, 22, and a third secondary receptacle 14 nested within a primary wastebasket 12 and supported and elevated therein by the top rims 28 thereof with the major axis of the third secondary receptacle 14 being perpendicular to the major axis of the primary wastebasket 12, or in hanging attachment therein supported and elevated by the hanger member 36.

It should be noted that the secondary receptacles 14 may be similarly utilized with a larger or differently shaped primary wastebasket 12 using the hanger members 36 in place of nesting the secondary receptacles 14 within the primary wastebasket 12 with the top rims 28 in contact.

A decal or other identifying label (not shown) may be affixed to each of the primary wastebasket 12 and secondary receptacles 14 to designate the type of waste materials to be disposed therein, the decals or identifying labels designating such categories of waste materials such as WASTE ONLY, NEWSPAPER, MIXED PAPER, PLASTIC, CANS, GLASS, BOTTLES, COMPUTER PAPER, LEDGER PAPER, or the like.

While the preferred embodiments of the above modular waste disposal receptacle system 10 have been described in detail with reference to the attached drawing Figures, it is understood that various changes and adaptations may be made in the modular waste disposal receptacle system 10 without departing from the spirit and scope of the appended claims.

What is claimed is:

1. A modular waste disposal receptacle system comprising:

at least one primary receptacle, said primary receptacle having a plurality of side walls oriented in a generally upright direction and a bottom wall oriented in a generally horizontal direction, said primary receptacle defining a generally open top receptacle region and a top rim, said primary receptacle further defining an exterior region opposing said generally open top receptacle region, said primary receptacle having a major axis and a minor axis, said major axis being generally greater in length than said minor axis;

at least one secondary receptacle, said secondary receptacle having a plurality of side walls oriented in a generally upright direction and a bottom wall oriented in a generally horizontal direction, each of said side walls of said secondary receptacle having a top edge, said secondary receptacle defining a generally open top receptacle region and a top rim, at least a portion of said top rim of said secondary receptacle extending outwardly from said top edge adjacent to two opposing ones of said side walls, said secondary receptacle having a major axis and a minor axis, said major axis of said secondary receptacle being generally greater in length than said minor axis of said secondary receptacle and approximately equal in length to said minor axis of said primary receptacle, such that said secondary receptacle may be selectively mounted in a nested configuration within said primary receptacle with said major axis of said secondary receptacle oriented generally perpendicular to said major axis of said primary receptacle such that said portion of said top rim of said secondary receptacle extends outwardly above and contacts said top rim of said primary receptacle adjacent to two opposing ones of said side walls thereof to elevate and support said secondary receptacle above said bottom wall of said primary receptacle, and a hanger member, said hanger member being connected to and extending from said secondary receptacle and positioned and oriented such that said secondary receptacle may be selectively mounted in hanging attachment on said top rim of said primary receptacle such that said secondary receptacle is either disposed either on said exterior region of said primary receptacle adjacent to and generally parallel with any one of said side walls of said primary receptacle or alternately disposed within said generally open top receptacle region of said primary receptacle adjacent to and parallel with at least one of said side walls of said primary receptacle that is parallel with said major axis of said primary receptacle.

2. The modular waste disposal receptacle system of claim 1 wherein the length of the major axis of the primary receptacle is greater than or equal to two times the length of the minor axis of the secondary receptacle, such that the number of the secondary receptacles which may be nested side-by-side within the primary receptacle is two.

3. The modular waste disposal receptacle system of claim 1 wherein the primary receptacle and the secondary receptacle are each integrally molded as unitary pieces from a plastic.

4. The modular waste disposal receptacle system of claim 1 wherein the number of the secondary receptacles is at least two, and wherein a first of the secondary receptacles is selectively mountable in the nested configuration within the primary receptacle, and further wherein a second of the second receptacles is selectively mountable in hanging attachment on the top rim of the primary receptacle using the hanger member.

5. The modular waste disposal receptacle system of claim 4 wherein the second of the secondary receptacles is mounted in hanging attachment on the top rim of the primary receptacle such that the second of the secondary receptacles is disposed in the exterior region surrounding the primary receptacle.

6. The modular waste disposal receptacle system of claim 4 wherein the number of secondary receptacles is at least three, and further wherein a third of the secondary receptacles is selectively mountable in hanging attachment on the top rim of the primary receptacle using the hanger member.

7. The modular waste disposal receptacle system of claim 6 wherein the third of the secondary receptacles is mounted in hanging attachment on the top rim of the primary receptacle such that the third of the secondary receptacles is disposed in the exterior region surrounding the primary receptacle, the second and the third of the secondary receptacles each being oriented with the major axes thereof generally perpendicular to the major axis of the primary receptacle, each of the second and the third of the secondary receptacles being positioned adjacent to opposing ones of the side walls of the primary receptacle.

8. The modular waste disposal receptacle system of claim 1 wherein the primary receptacle has a predetermined overall shape and a predetermined overall size, and wherein each of the secondary receptacles have a predetermined overall shape substantially similar to said predetermined overall shape of the primary receptacle and a predetermined overall size smaller than said predetermined overall size of the primary receptacle.

9. The modular waste disposal receptacle system of claim 8 wherein the predetermined overall size of each of the secondary receptacles are substantially the same as one another.

10. The modular waste disposal receptacle system of claim 1 wherein the primary receptacle has a height on the order of 15", the length of the major axis is on the order of 13", and the length of the minor axis is on the order of 9¼".

11. The modular waste disposal receptacle system of claim 1 wherein the secondary receptacle has a height on the order of 9¾", the length of the major axis is on the order of 9¼", and the length of the minor axis is on the order of 5¼".

12. A modular waste disposal receptacle system comprising:

at least one primary receptacle, said primary receptacle having a plurality of side walls oriented in a generally upright direction and a bottom wall oriented in a generally horizontal direction, said side walls and said bottom wall being integrally formed with one another, said primary receptacle defining a generally open top receptacle region and a top rim and having a predetermined overall shape and a predetermined overall size, said primary receptacle further defining an exterior region opposing said generally open top receptacle region; and at least one secondary receptacle, said secondary receptacle having a plurality of side walls oriented in a generally upright direction and a bottom wall oriented in a generally horizontal direction, said side walls and said bottom wall of said secondary receptacle being integrally formed with one another, said secondary receptacle defining a generally open top receptacle region and a top rim and having a predetermined overall shape substantially similar to said predetermined overall shape of said primary receptacle and a predetermined overall size smaller than said predetermined overall size of said primary receptacle, such that said secondary receptacle may be selectively mounted in a nested configuration within said primary receptacle with said major axis of said secondary receptacle oriented generally perpendicular to said major axis of said primary receptacle such that at least a portion of said top rim of said secondary receptacle extends outwardly above and contacts said top rim of said primary receptacle adjacent to two opposing ones of said side walls thereof to elevate and support said secondary receptacle above said bottom wall of said primary receptacle, said secondary receptacle further including a hanger member connected thereto and extending therefrom, said hanger member being positioned and oriented such that said secondary receptacle may be mounted in hanging attachment on said top rim of said primary receptacle and selectively disposed either within said open top receptacle region of said primary receptacle or alternately in said exterior region surrounding said primary receptacle.

* * * * *